US009876290B2

(12) United States Patent
Frank

(10) Patent No.: US 9,876,290 B2
(45) Date of Patent: Jan. 23, 2018

(54) APPARATUS FOR MAKING CONTACT WITH AN ELECTRICAL CONDUCTOR, AND CONNECTION OR CONNECTING DEVICE WITH AN APPARATUS OF THIS KIND

(71) Applicant: PFISTERER KONTAKTSYSTEME GMBH, Winterbach (DE)

(72) Inventor: Erich Frank, Hochdorf (DE)

(73) Assignee: PFISTERER KONTAKTSYSTEME GMBH, Winterbach (DE)

( * ) Notice: Subject to any disclaimer, the term of this patent is extended or adjusted under 35 U.S.C. 154(b) by 0 days.

(21) Appl. No.: 15/318,018

(22) PCT Filed: Jun. 5, 2015

(86) PCT No.: PCT/EP2015/001140

§ 371 (c)(1),
(2) Date: Dec. 12, 2016

(87) PCT Pub. No.: WO2015/188923

PCT Pub. Date: Dec. 17, 2015

(65) Prior Publication Data

US 2017/0104283 A1 Apr. 13, 2017

(30) Foreign Application Priority Data

Jun. 12, 2014 (DE) ..... 10 2014 008 756

(51) Int. Cl.
*H01R 11/01* (2006.01)
*H01R 4/26* (2006.01)

(52) U.S. Cl.
CPC ..... *H01R 11/01* (2013.01); *H01R 4/26* (2013.01)

(58) Field of Classification Search
CPC ..... H01R 4/20
(Continued)

(56) References Cited

U.S. PATENT DOCUMENTS 1,904,162 A 4/1933 Milliken
2,379,942 A * 7/1945 Webber ..... H01R 13/621 174/102 SC (Continued)

FOREIGN PATENT DOCUMENTS

DE 18 21 749 5/1960
DE 11 13 021 8/1961

(Continued)

OTHER PUBLICATIONS

International Search Report (ISR) dated Sep. 24, 2015 in International (PCT) Application No. PCT/EP2015/001140.

*Primary Examiner* — Ross Gushi
(74) *Attorney, Agent, or Firm* — Wenderoth, Lind & Ponack, L.L.P.

(57) ABSTRACT

An apparatus (1) for making contact with an electrical conductor (10, 20), in particular a cable conductor of a power supply cable, has a connecting body (4) that delimits a receiving space (6) into which the conductor (10, 20) with which contact is to be made can be inserted by way of its end. The apparatus (1) has a contact medium (30) with which electrical contact can be made with the end of the conductor (10, 20) under the action of a contact force. The contact medium (30) has a large number of electrically conductive contact bodies (32) introduced into the receiving space (6) and bearing against one another. At least some of the contact bodies can be brought into electrical contact-making contact with the ends of the conductors (10, 20).

27 Claims, 4 Drawing Sheets

(58) Field of Classification Search
USPC ..... 174/84 C
See application file for complete search history.

(56) References Cited

U.S. PATENT DOCUMENTS 2,472,214 A * 6/1949 Hurvitz ..... G01L 9/0002 324/691
2,901,725 A * 8/1959 Schuyler ..... H01R 4/32 174/84 S
2,958,723 A * 11/1960 Logan ..... H01R 4/20 174/84 C
3,052,750 A * 9/1962 Cobaugh ..... H01R 4/203 174/90
3,125,739 A * 3/1964 Deibel ..... H01C 10/106 200/86.5
3,165,575 A * 1/1965 Lynch, Jr. ..... H01R 4/20 174/77 R
3,184,535 A * 5/1965 Worthington ..... H01R 4/08 174/90
3,322,885 A * 5/1967 May ..... H01R 4/58 174/76
3,386,069 A 5/1968 Eriksson
3,451,609 A * 6/1969 Gillett ..... H01R 4/723 174/84 R
3,503,034 A * 3/1970 Appleton ..... H01R 31/00 439/179
3,525,799 A * 8/1970 Ellis ..... H01R 4/723 174/84 R
3,538,240 A * 11/1970 Sherlock ..... H01R 4/01 174/88 R
3,760,342 A * 9/1973 Prouty ..... H01R 13/2414 338/100
3,835,442 A * 9/1974 Anderson ..... H01R 31/02 174/257
3,864,013 A * 2/1975 Levy ..... H01R 4/20 174/84 C
3,870,978 A * 3/1975 Dreyer ..... H01P 1/045 333/24 C
3,871,737 A * 3/1975 Dorrell ..... H01R 13/187 439/188
3,947,959 A * 4/1976 DuRocher ..... H01R 13/111 29/878
4,103,984 A * 8/1978 Mixon, Jr. ..... H01R 4/24 439/415
4,151,364 A * 4/1979 Ellis ..... B29C 61/003 174/84 C
4,166,666 A * 9/1979 Reese ..... H01R 3/08 174/94 R
4,214,121 A * 7/1980 Charneski ..... H01R 3/08 174/84 C
4,220,386 A * 9/1980 Kenny ..... A61N 1/3752 439/281
4,234,758 A * 11/1980 Guzy ..... H02G 15/10 156/49
4,262,982 A * 4/1981 Kenny ..... A61N 1/3752 439/281
4,269,465 A * 5/1981 Mueller ..... H01R 4/36 439/431
4,795,365 A * 1/1989 Johnston ..... H01R 4/2491 439/411
4,797,509 A * 1/1989 Cook ..... H01R 4/20 156/49
4,829,146 A * 5/1989 Duve ..... H01R 4/20 174/84 C
4,832,248 A * 5/1989 Soni ..... H01R 4/723 174/84 R
4,839,470 A * 6/1989 Ventura ..... H01R 4/20 156/49
4,859,194 A * 8/1989 Bartholomew ..... H01R 24/20 439/125
5,000,705 A * 3/1991 Kinka ..... H01R 4/5091 439/791
5,006,286 A * 4/1991 Dery ..... H01R 4/04 174/76
5,137,476 A * 8/1992 Noble ..... H01R 4/36 439/793
5,137,959 A * 8/1992 Block ..... C01F 7/02 524/430
5,140,746 A * 8/1992 Debbaut ..... H01B 17/60 174/76
5,174,765 A * 12/1992 Williams ..... E21B 17/028 439/426
5,183,593 A * 2/1993 Durand ..... C09J 163/00 252/511
5,315,065 A * 5/1994 O'Donovan ..... H01R 4/20 174/84 C
5,326,636 A * 7/1994 Durand ..... C09J 163/00 428/209
5,364,281 A * 11/1994 Leto ..... H01R 4/60 403/378
5,369,225 A * 11/1994 Natwig ..... H01R 4/723 174/84 R
5,380,212 A * 1/1995 Smeenge, Jr. ..... H01R 13/2414 439/86
5,393,932 A * 2/1995 Young ..... H01Q 1/244 174/84 R
5,422,438 A * 6/1995 Lamome ..... H01R 4/203 174/76
5,514,835 A * 5/1996 Wing ..... H01R 4/183 174/84 C
5,630,735 A * 5/1997 Eckert ..... H01R 4/30 439/721
5,630,737 A * 5/1997 Dupont ..... H01R 4/26 439/431
5,672,846 A * 9/1997 Marie-Louise Debbaut ..... H01B 17/60 174/76
5,683,273 A * 11/1997 Garver ..... H01R 4/5025 174/84 R
5,800,195 A * 9/1998 Endo ..... H01R 13/5221 439/271
5,801,332 A * 9/1998 Berger ..... H02G 15/103 174/73.1
5,821,463 A * 10/1998 Ngo ..... H01R 4/26 174/84 C
5,823,802 A * 10/1998 Bartley ..... G01L 23/10 439/86
5,875,547 A * 3/1999 Larsson ..... H01R 4/70 156/49
6,042,430 A * 3/2000 Hollick ..... F16B 31/021 411/309
6,310,292 B1 * 10/2001 Osborn ..... H01R 4/20 174/84 C
6,454,598 B1 * 9/2002 Burwell ..... H01R 4/726 174/84 C
6,479,763 B1 * 11/2002 Igaki ..... C09J 9/02 174/260
6,531,022 B1 * 3/2003 Tsukahara ..... H01L 21/563 156/256
6,658,735 B2 * 12/2003 Ito ..... H01R 4/183 174/84 C
6,733,308 B2 * 5/2004 Jedlitschka ..... H01B 1/22 439/86
6,838,620 B2 * 1/2005 Murakami ..... H01R 4/206 174/84 C
7,014,514 B2 * 3/2006 Zahnen ..... H01R 4/36 439/798
7,156,703 B1 * 1/2007 Hurley, III ..... H01R 4/36 439/814
7,174,633 B2 * 2/2007 Onuma ..... H01R 4/04 29/854
7,196,268 B2 * 3/2007 Vaughn ..... H01R 4/72 174/76
7,211,725 B1 * 5/2007 Tait ..... H02G 3/0616 174/50
7,256,348 B1 * 8/2007 Endacott ..... H01R 4/183 174/84 C

(56) References Cited

U.S. PATENT DOCUMENTS 7,292,894 B2 * 11/2007 Belden ..... A61N 1/05 439/880
7,306,469 B1 * 12/2007 Slautterback ..... H01R 13/633 439/593
7,394,022 B2 * 7/2008 Gumley ..... H01R 4/206 174/84 C
7,683,260 B2 * 3/2010 Bertini ..... H01R 13/5205 174/84 C
RE41,663 E * 9/2010 Vinther ..... G01R 1/06716 174/260
7,896,712 B2 * 3/2011 Cecil ..... H01R 4/20 439/523
7,906,046 B2 * 3/2011 Sokol ..... H01R 4/186 174/66
7,954,235 B2 * 6/2011 Martauz ..... H01R 4/184 174/84 C
8,007,690 B2 * 8/2011 Yamakawa ..... H05K 1/092 174/257
8,268,196 B2 * 9/2012 Sokol ..... H01R 4/186 174/66
8,344,252 B2 * 1/2013 Steele ..... H02G 15/192 174/84 R
8,350,155 B2 * 1/2013 Kobayashi ..... H01R 4/186 174/84 R
8,425,265 B2 * 4/2013 Stauch ..... H01R 4/363 439/475
8,481,860 B2 * 7/2013 Kim ..... B82Y 30/00 136/256
8,550,842 B1 * 10/2013 Gutierrez ..... H01R 4/36 174/74 R
8,708,723 B2 * 4/2014 Stoltz ..... B01F 7/001 29/845
8,747,170 B2 * 6/2014 Cornelius ..... H01R 4/36 439/798
8,981,224 B2 * 3/2015 Kehl ..... H01R 4/70 174/84 R
8,987,595 B2 * 3/2015 Bumgarner ..... H01R 4/363 174/84 R
9,184,517 B1 * 11/2015 Endacott ..... H01R 4/183
9,240,649 B2 * 1/2016 Battle ..... H01R 13/621
9,252,527 B2 * 2/2016 Aizawa ..... H01R 4/72
9,379,531 B2 * 6/2016 Boedec ..... H01R 4/021
9,450,316 B2 * 9/2016 Diop ..... H01R 4/5075
9,472,865 B2 * 10/2016 Frank ..... H01R 4/307
9,528,537 B2 * 12/2016 Gainor ..... F16B 1/0014
9,553,374 B1 * 1/2017 Murugiah ..... H01R 4/36
9,559,439 B2 * 1/2017 Jaroschek ..... H01R 4/36
9,589,698 B2 * 3/2017 Anhalt ..... C08K 7/00
2001/0052420 A1 * 12/2001 Ito ..... H01R 4/183 174/84 C
2002/0074282 A1 * 6/2002 Herrmann ..... B01D 39/12 210/490
2002/0096353 A1 * 7/2002 Hanazaki ..... H01R 4/20 174/84 C
2002/0117652 A1 * 8/2002 Sano ..... H01B 1/026 252/500
2002/0182904 A1 * 12/2002 Siebert ..... H01R 9/032 439/86
2004/0074667 A1 * 4/2004 Endacott ..... H01R 4/187 174/84 R
2006/0137488 A1 * 6/2006 Sakaue ..... B22F 1/0007 75/255
2007/0184715 A1 * 8/2007 Onuma ..... H01R 4/04 439/587
2007/0193410 A1 * 8/2007 Matsuki ..... C22C 1/0425 75/255
2007/0209475 A1 * 9/2007 Sakaue ..... B22F 1/0014 75/255
2008/0042111 A1 * 2/2008 Sakaue ..... B22F 1/025 252/520.1
2010/0147585 A1 * 6/2010 Kobayashi ..... H01R 4/186 174/84 C
2010/0319990 A1 * 12/2010 Gumley ..... H01R 4/206 174/84 C
2011/0092112 A1 * 4/2011 Battle ..... H01R 4/36 439/814
2011/0260115 A1 * 10/2011 Kim ..... B82Y 10/00 252/503
2012/0021634 A1 1/2012 Stauch et al.
2013/0309882 A1 * 11/2013 Lin ..... H01R 13/6591 439/86
2014/0063683 A1 * 3/2014 Gu ..... H01G 4/30 361/301.4
2015/0357078 A1 * 12/2015 Lessing ..... G01L 1/20 73/774
2016/0099110 A1 * 4/2016 Lee ..... H01G 4/30 361/301.4
2016/0114390 A1 * 4/2016 Hori ..... B22F 9/24 252/512

FOREIGN PATENT DOCUMENTS

DE 11 13 973 9/1961
DE 34 12 849 10/1984
DE 10 2004 049 226 4/2006
EP 0 209 399 1/1987
EP 2 226 899 9/2010
EP 2 683 034 1/2014
FR 754 583 10/1933

* cited by examiner

APPARATUS FOR MAKING CONTACT WITH AN ELECTRICAL CONDUCTOR, AND CONNECTION OR CONNECTING DEVICE WITH AN APPARATUS OF THIS KIND

FIELD OF THE INVENTION

The invention relates to an apparatus for making contact with an electrical conductor, in particular a multi-wire conductor of a power supply cable, and a connection or connecting device with such an apparatus.

BACKGROUND OF THE INVENTION

In order to reduce losses during power transmission in the case of cable conductors with large cross sections of, for example, more than 100 $mm^2$—and in particular more than 1000 $mm^2$—in medium and high voltage cables, conductor designs formed from individual wires are increasingly used. Insulating materials are inserted between the individual wires or between segments constructed from individual wires. Alternatively, the individual wires are coated with insulating materials. Such conductor constructions minimize the undesirable skin and proximity effects, in particular in the case of large cross sections, so as to increase the transmission capacity of the cable or work with smaller cross sections.

The conductors are preferably divided into several segments, which are put together using tapes or other insulating layers to form conductors with a circular cross section. Inside the segments, the individual wires, which may also be insulated from one another, are twisted and drawn through a form mold, so that the current is subsequently conducted in the individual wires always following the wire course in the longitudinal direction of the cable from the external layer into the inside of the conductor. The segments are usually bound on the outside with tapes during production and are electrically insulated from one another. Such cable conductor constructions are known, for example, from U.S. Pat. No. 1,904,162 and are also referred to as a MILLIKEN design.

The economic advantage of this construction in terms of optimization of material costs has to be weighed against the disadvantage that the conductor preparation during installation requires significant effort and time to ensure that even the inner-lying wires of the conductor can make contact with the connecting point, and can then contribute to the power transmission. The insulating materials usually have to be completely removed from the conductor assembly. The individual wires must be freed from the insulating materials, unbent and brushed. Then, the individual wires are again brought together manually with the aid of hose clamps and pressing tools to form an almost circular shape with the diameter of the original conductor so that they can be introduced into the connecting element and adequately compressed and retained by it. The effectiveness of these measures is dependent on the care taken during assembly.

An apparatus with the features of the preamble of Claim 1 is known from EP 2 226 899 A1, in which apparatus a wedge-shaped lug acting as a contact medium can be radially screwed into a tubular clamping body, and can thus be brought into contact-making contact with the front ends of the two conductors that are axially inserted into the clamping body at opposite sides then electrical connection is established between the two conductors.

SUMMARY OF THE INVENTION

The problem addressed by the invention is to provide an apparatus for making contact with an electrical conductor, in particular a multi-wire conductor of a power supply cable, and a connection or connecting device with such an apparatus. The invention remedies the disadvantages of the prior art. In one embodiment, in particular the assembly of such apparatuses and thus the production of connection or connecting devices according to the invention is to be simplified, while constantly ensuring a high level of contact reliability and a high current-carrying capacity.

In one embodiment, the apparatus according to the invention for making contact with an electrical conductor, in particular a cable conductor of a power supply cable, has a connecting body. The conductor with which contact is to be made can be inserted into the connecting body by its front end. The apparatus also has a contact medium, with which electrical contact can be made with the front end of the conductor. The contact medium has a plurality of electrically conductive contact bodies, of which at least some can be brought into electrical contact-making contact with the front end of the conductor, and preferably with the entire front end of the conductor. Due to the contact bodies, the contact force can be transmitted to adjacent contact bodies and/or to the conductor with which contact is to be made and/or to the connecting body. In particular, from a force application point of the connecting body, for example, a pressure screw can be screwed into the connecting body, as far as the front surface of the conductor with which contact is to be made. An apparatus according to the invention can be used for electrically connecting two or more conductors as well as for the connection of one or more conductors to an electrical appliance.

The connecting body can be in one part, which simplifies, for example, the absorption of the clamping forces and contact forces applied, or in multiple parts, which simplifies, for example, the assembly of the apparatus because already laid cables, for example, no longer have to be moved in the longitudinal direction during installation. Instead, the cable ends can swing sideways to the connection point or the other cable end, which is advantageous particularly in the case of large conductor cross sections. The connecting body can be at least partially sleeve-shaped, so that the conductor with which contact is to be made or the conductors to be connected to one another can be inserted into or laid in the sleeve-shaped section. At least some and preferably all of the contact bodies can have an identical shape and preferably also have an identical size.

The invention offers particular advantages in the case of making contact with multi-wire conductors, for example of cable conductors of the MILLIKEN design. The present invention substantially improves the functional level of the connections known from the prior art because the circumferential surface at the conductor end is not or at least not only used for the power transmission, as was previously the case. Instead, also or even exclusively, the front side of the conductor, and preferably the entire front surface of the conductor is used. In addition, this design permits the use of relatively compact connecting systems, which require less installation space, and thus, allow smaller, easier to install and more cheaply produced installation systems to be used in fittings.

The front surface of the conductor increases geometrically proportional to its cross section. In all of the different prior art conductor constructions, the front side is the only surface which can be particularly easily provided as a bare metal object. The cables are thus usually shortened upon installation to the appropriate length, and are preferably cut. All other surfaces of the conductor that are to make contact with must be prepared in a separate operation using more or less effort.

Unlike the conventional molding and screwing technology, in the apparatus according to the invention, no transverse force needs to be applied to the conductor at the clamping point to establish the electrical transverse conductivity between the individual wires and the connecting body. This structure is advantageous because such a transverse conductivity becomes more difficult to achieve with larger cross sections and/or partially insulated conductor constructions.

The electrical and mechanical functions of the contact apparatus can be divided into two sections that can also be spatially separated from one another or even spaced apart. Namely, a first section, which is responsible for the transportation of electricity and provides a low electrical resistance with short current paths using metal masses with good thermal conductivity, is separated from a second section, which is responsible for the mechanical fixation and force transmission and which provides, with a smaller design size, a high mechanical strength and a robust design suitable for the construction site with adequate tolerance to differences between planned and delivered conductor design, thus ensuring an error-proof and time-saving installation.

Apparatuses according to the invention can thus be designed very narrow and compact because the current conduction runs directly from one conductor end to the other conductor end or to a contact surface. The sleeve-shaped connecting body is designed primarily for the mechanical stress requirement, which requirement can be satisfied with the use of high-strength materials with smaller wall thicknesses than those conventionally used. This arrangement permits the use of smaller and cheaper insulating bodies of cable fittings.

In one embodiment of the invention, the contact force can be transmitted in an essentially direction-independent manner to adjacent bearing contact bodies, and/or the conductor to be made contact with and/or the connecting body. This arrangement ensures a pressure distribution, and thus a force distribution, which is virtually hydrostatic. This force distribution results in the electrical contacting of the conductor occurring over a short connecting distance.

In one embodiment of the invention, at least part of the contact bodies has an at least partially curved surface, in particular an at least partially spherical surface, and preferably at least part of the contact bodies is formed ball-shaped. Contact bodies formed in this way permit a force transmission between the contact bodies and/or the conductor with which contact is to be made and/or the connecting body that is particularly advantageous for the electrical contacting. In particular, the use of balls as contact bodies is advantageous because they allow in a simple manner an isotropic force distribution.

In one embodiment of the invention, the electrically conductive contact bodies have an electrically conductive surface coating, which constantly has a lower contact resistance compared with the material of the contact bodies. While the contact bodies can be made, for example, from copper or aluminum, the coating can be made, for example, from gold or silver or also from tin or zinc, or also from an alloy using at least one of these elements. This coating permits a constantly low contact resistance to adjacent bearing contact bodies and/or to the conductor with which contact is to be made, in particular to uncoated copper or aluminum conductors, and/or to the connecting body, while the contact bodies have a high level of pressure strength.

The thickness of the surface coating can be more than 1 μm and less than 25 μm, in particular more than 2 μm and less than 10 μm, and preferably more than 2.5 μm and less than 6 μm. The size of the contact bodies, in particular of the ball-shaped contact bodies, is to be selected such that, on the one hand, they cannot enter into anticipatable cavities or gaps filled with insulating materials on the conductor front surfaces. On the other hand, the size is to be selected small enough that a virtually hydrostatic balance of the contact bodies is achieved in the case of point loading. As far as possible, every individual wire is contacted on the front side of at least one, and preferably of at least two, contact bodies. In the case of ball-shaped contact bodies, the ball diameter should be selected significantly smaller than the individual wire diameter of the conductor.

In one embodiment of the invention, the contact medium has a pasty mass that is preferably tough-elastic at room temperature, in which the contact bodies are embedded. This mass is also advantageous for the installation, because the positioning and dosing of the contact bodies is simplified. By comparison, the handling of loose contact bodies, in particular of balls, is problematic on the installation site. The mass can permit a homogeneous distribution of the contact bodies, and/or a dimensionally-stable application of the contact bodies to the prepared conductor front surface, and/or cannot adhere to the installation tool when used as intended, and/or can prevent an oxidation of the electrical contacts, and/or cannot spread into remaining cavities and cannot react chemically with the known insulating materials, and/or cannot change the electrical properties of a conductor smoothing layer or of the cable primary insulation.

In one embodiment, the apparatus has a force application element acting on the contact medium and in particular on the contact bodies, by which the contact force can be applied to the contact medium. The necessary contact force can be generated after the introduction of the contact bodies into the receiving space delimited by the deformation body and the conductor with which contact is to be made, for example, by one or more pressure screws that can be screwed into the deformation body.

In one embodiment, the apparatus has a force storage acting on the contact medium and, in particular, the contact bodies, by which the contact force can be constantly maintained. The minimum holding force required for uninterrupted operation should be balanced and maintained by a suitable spring accumulator once all settling losses have disappeared and taking into account the operation-related reversible volume changes due to thermal expansion of the materials. The force storage can also be integrated into the force application element. The desired pre-tension can be applied in a simple manner by the installer by tightening of the pressure screw(s) and controlled by the torque to be applied, for example, also by screws with tear-off heads. Alternatively or additionally, indicators can indicate that the springs are adequately tensioned. The installer then receives clear feedback that the assembly has been correctly realized, and the connection can satisfy the requirements during operation.

In one embodiment, the apparatus has at least one force indicator or at least one signal element, each of which indicates that the contact medium is adequately tensioned by the force storage or contact storage. Such an indication, for example, with signal elements in the form of force indicators simplifies the assembly, while simultaneously ensuring a relatively narrowly tolerated tensioning of the contact.

In one embodiment, the apparatus has a fixation device for fixing the conductor with which contact is to be made to the connecting body, in particular for fixing the axial position of the conductor with which contact is to be made relative to the connecting body. The fixation device in particular absorbs forces in the longitudinal direction of the conductor that act on the conductor from the outside during the installation and during the operation. In a multi-wire conductor, for example, the fixation device fixes the individual wire assembly at the clamping point in the transverse direction of the conductor, clamps the individual wires at the front side of the prepared conductor ends in a maximally form-fitting manner and forms a stable counter bearing for the contact bodies that are under pressure from the contact force.

The invention also relates to a connection and connecting device with an apparatus as described above and with a contacted electrical conductor, in particular a multi-wire cable conductor of a power supply cable. At least some of the contact bodies are in electrical contact-making contact with the front end of the conductor. This arrangement permits in a simple manner a constantly reliable and large-area electrical contacting of the conductor.

In one embodiment, at least part of the contact body has an at least partially curved surface, in particular an at least partially spherical surface, and preferably at least part of the contact bodies is formed ball-shaped. The radius of the curved surface is less than 50% of a narrow side of the front surface of the contacted conductor or of the wires of a multi-wire conductor, in particular less than 40% and preferably less than 25%. This arrangement ensures that at least one contact body contacts on every individual wire of the conductor.

In one embodiment, the conductor has multiple wires, and at least one expansion element is inserted into the front end of the contacted conductor. Preferably, an expansion element is inserted centrally into the front end of the contacted conductor. A radial widening of the conductor is then obtained, which is advantageous to be able to clamp the conductor at the contact point in a pressure-resistant manner. Without the entry of at least one expansion element in the center of the conductor that, in many conductor constructions, is in any case filled with a soft plastic, which must be replaced due to the required pressure stability, a kind of arch would be created. In the case of a radial loading from the outside towards the center, the arch undesirably absorbs the pressure load and dissipates it in the circumferential direction. The radially exerted clamping force would then not act on the inner wire layers. Due to the widening of the conductor cross section by the expansion element, in particular a central pin, the individual wires no longer contact with the adjacent wires, and the force acting from the outside is now transmitted onto the wires below and not supported transversely. This arrangement allows the clamping force to act as far as the center of the conductor, and individual wires are fixed more effectively.

The expansion element can be at least partially conical or wedge-shaped. The expansion element can have one or more sections that can preferably be detached in a tool-free manner. After an adequate entry of the expansion element into the conductor, the expansion element then can be detached at the front side of the conductor, preferably without the part remaining in the conductor projecting over the front surface of the conductor.

To clamp and adequately fix the individual wires of a multi-wire conductor in the radially outermost position, radially acting clamping screws can be used that are arranged, for example, distributed on the circumference of the connecting body. For this purpose, the clamping screws can be arranged at a small spacing on the circumference. If necessary, the clamping screws can be arranged in two or more rows behind one another in the axial direction. Annular cutting edges or tapered surfaces on the heads of the clamping screws are advantageous for a large-area clamping contact of preferably several individual wires.

To offset the conductor diameter tolerance encountered in practice, advantageously an adaptation of the connecting body to the actual conductor diameter is obtained. The remaining gap must be smaller than the inserted contact bodies to prevent the contact bodies from entering into the gap. This gap can be adequately reduced during installation, for example, by conical shaping of the conductor receiving hole and axial displaceability of the contact part.

In one embodiment, an annular element is mounted on or near to the front end on the contacted conductor. The external diameter of the annular element is adapted to the receiving space of the connecting body. In particular, the external diameter of the annular element can essentially correspond to the clear width of the receiving space of the connecting body. Alternatively or additionally, the internal diameter of the annular element can be adapted to the external diameter of the conductor with which contact is to be made. In particular, the internal diameter of the annular element can essentially correspond to the external diameter of the conductor with which contact is to be made. A centering of the conductor in the conducting body can then be achieved, and/or the circumferential contour of the conductor, in particular its roundness, can be ensured.

In particular, when the annular element is installed before the entry of the expansion element, it serves as a radial delimitation and as fixation of the conductor and ensures the circumferential contour thereof when the expansion element is subsequently introduced and when the conductor assembly accordingly attempts to widen radially. At the same time, the form fit between the individual wires is reduced in the transverse direction and improved relative to the annular element. The gap at the external diameter of the conductor closes. The clamping force for the subsequent mechanical fixation of the conductor assembly can act through the clamping screws and as far as the center. Several annular elements with different dimensions can be provided, in particular with different internal diameters, so that, using a connecting body, the selection of a suitable annular element also allows conductors with different dimensions to be contacted.

The following factors must be taken into account during the contacting of conductor front surfaces. The cut front surface of a multi-wire conductor is a bare metal object in the manually executed installation, but it is very rough due to corrugations and can also be cut obliquely to the cable direction. These shape variations occurring in the cable preparation are not definable. The front surface, which is available for the contacting, corresponds to the supplied conductor cross section, which is usually somewhat smaller than the nominally specified cross section from the cable's data sheet. The front surface to be contacted can have individual wires with diameters that may differ. The individual wires may be covered with thin insulating layers at the wire surface and can have, due to compression during production, different cross-sectional shapes that may differ from the ideal circular shape. The individual wires may not be connected to one another in cross section and can be moved towards one another to a limited extent in the longitudinal and transverse directions. They are held in the longitudinal bracing only by twisting and form fitting. Insulating materials in the form of powder, tape or homogeneous plastic fillings can be provided individually or in combination between the individual wires. The insulating materials are usually less pressure-resistant than the front surfaces of the wires, and therefore, yield under mechanical loading. The relaxation and settling behavior in the case of point and/or planar pressure loading corresponds to the values typical of plastics, which are far below the characteristic values to be expected with pure metals. Larger gussets can be provided between conductor segments and/or centrally inserted hollow conductors or plastic cords.

Features mentioned in the description can be essential to the invention on their own or in any combination.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
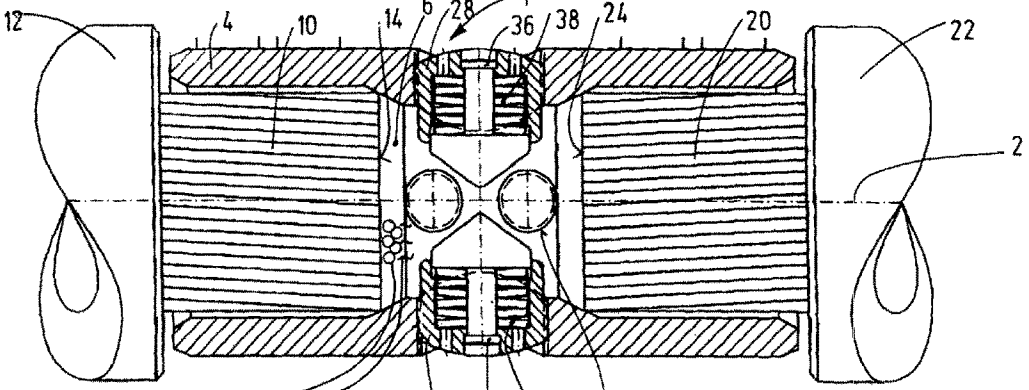
FIG. 1 is a side view in section of an apparatus according to a first exemplary embodiment of the invention.
Figure 2:
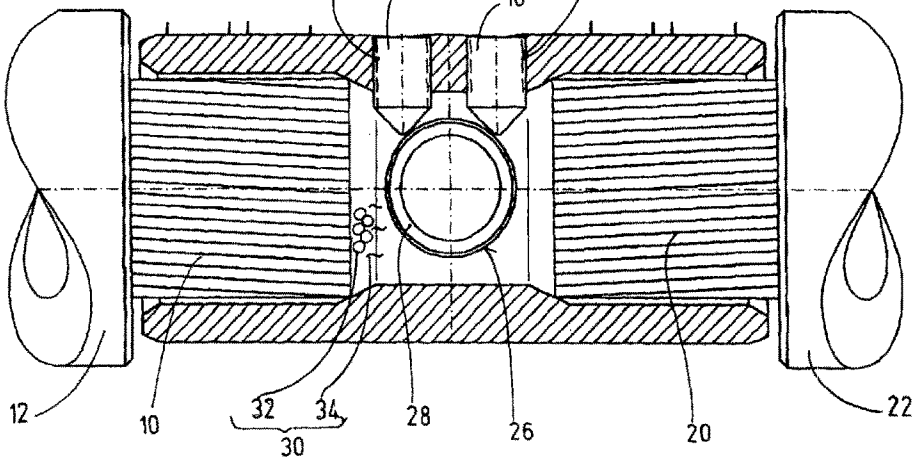
FIG. 2 is a side view in section of the apparatus of the first exemplary embodiment rotated 90° about the longitudinal axis of the apparatus.

FIG. 1 shows a longitudinal section through a first exemplary embodiment of an apparatus 1 according to the invention for making contact with a multi-wire electrical conductor 10. In this case the apparatus connects a first multi-wire electrical conductor 10 to a second multi-wire electrical conductor 20. The cable conductors 10, 20 are parts of a first power supply cable 12 and a second power supply cable 22, respectively. The two conductors 10, 20 lie in the region of the apparatus 1 coaxial to the longitudinal axis 2 of the apparatus 1. FIG. 2 also shows a longitudinal section through the apparatus 1, in which the apparatus 1 is rotated 90° about the longitudinal axis 2.

The first exemplary embodiment serves to connect conductors 10, 20 having the same cross section and uses as an external contact system the tubular connecting body 4 which, like a normal press connector, is slid onto the prepared ends of the conductors 10, 20 at the left and right and is pressed in, for example, with hydraulic tools. In a similar way to the case of a conventional press connector, with appropriate conductivity the connecting body 4 can also be used for the power transmission of the bare conductor wires of the two conductors 10, 20, which conductor wires are contacted on the surface. Because possible insulating layers were not removed from the individual wires and only the two outer layers are, from experience, involved in the transport of current in the case of multilayer cables, this contact alone does not establish an adequate electrical contact. The pressing then ensures in particular that the two ends of the conductors 10, 20 are fixed on the connecting body 4 and are then connected to one another in a mechanically stable manner.

Because the front ends 14, 24 of the conductors 10, 20 are also radially clamped and can only move slightly or not at all in the longitudinal direction, a receiving space 6 is delimited axially by the two conductors 10, 20 and radially by the connecting body 4. Contact bodies 32 are introduced into that receiving space and are embedded in a pasty mass 34. Together the contact bodies and pasty mass form the contact medium 30 of the apparatus 1, which contact medium is only partially depicted for reasons of clarity.

The contact bodies 32 are formed by balls made from copper, have a uniform size and are covered with a 3 μm to 5 μm thick layer of tin. The diameter of the balls is more than 10% and less than 100% of the extension of the narrow side of a wire of the conductor 10, 20, in particular more than 15% and less than 90% and preferably more than 20% and less than 85%. The pasty mass 34 can comprise a silicone gel or another paste with suitable viscosity.

After the introduction of an adequate quantity of the contact medium 30, for example via the two first threaded openings 16 abutting the receiving space 6 and arranged one behind the other along the longitudinal axis 2, a threaded pin or a tear-off screw acting as a force application element 18 is screwed into these threaded openings 16 and the receiving space 6 is then closed, and the contact medium 30 is placed under pressure with further screwing in of the screws.

The apparatus also has two force storages 28, which each have a set of disk springs 38 and are inserted into the connecting body 4 radially at sides axially opposite one another. The force storages 28 are screwed into corresponding second threaded holes 26 and then stuck therein. The two force application elements 18 are screwed into the connecting body 4 and tightened until force indicators in the form of signal elements 36 on the force storages 28 indicate that the contact medium 30 is adequately tensioned. The force storages 28 are dimensioned such that they maintain the minimum necessary holding force even if, due to thermal load changes and constant relaxation losses, the volume between the two conductors 10, 20 were to expand, or the ends of the two conductors 10, 20 were to nevertheless move a little.

Figure 3:
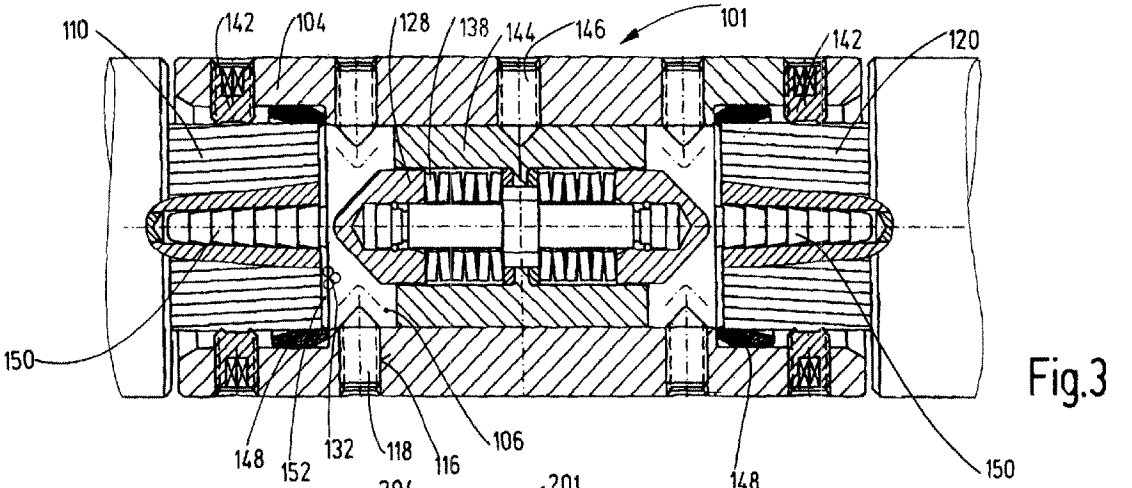
FIG. 3 is a side view in section of an apparatus according to a second exemplary embodiment of the invention.

FIG. 3 shows a longitudinal section through a second exemplary embodiment of the invention with an apparatus 101, in which a one-part tube is pushed as a connecting body 104 over the ends of the two different or cross-sectionally identical conductors 110, 120. The two conductors 110, 120 are then fixed by the axially outermost holding screws 142 to the connecting body 104, which screws form part of a fixing device of the apparatus 301. The central part 144 with the force storage means 128 or spring sets 138 is already installed in the connecting body 104 and fixed there axially and radially at the center. With such design, a portion of the current load can flow over the holding screws 142 and the connecting body 104. However, this flow is not absolutely necessary and permits more compact designs of the apparatus 101. An advantage of this exemplary embodiment is that all connections can be tightened with customary tools for attachment devices. No special tools are required.

The preferably ball-shaped contact bodies 132 are introduced via the still open holes 116 for the force application elements 118, until the receiving space 106 between the conductors 110, 120 is completely filled. The contact force is applied by the force application elements 118, which are formed, for example, by threaded pins and which are finally screwed into the holes 116 and tightened, until no screw protrusion can be seen.

The centering screw 146 in the center of the connecting body 104 fixes the pre-tensioned force storages 128 with its sets of disk springs 138. By torque-controlled tightening of the total of four force application elements 118 of the dimension M12, the contact bodies 132 are placed under pressure and the force storage 128 is pre-tensioned.

The connecting body 104 can be formed by a tube or by connectable half shells. The half shells can be placed around the conductors 110, 120 and clamped by a suitable device relative to one another and to the conductors 110, 120.

An annular element 148 is mounted on each of the two conductors 110, 120 at their front ends. The external diameter of each annular element 148 is adapted to the receiving space 106 of the connecting body 104, and in particular essentially corresponds to the clear width of the receiving space 106 of the connecting body 104. The internal diameter of each annular element 148 is adapted to the external diameter of the conductor 110, 120 with which contact is to be made, in particular essentially corresponds to the external diameter of the conductor 110, 120 with which contact is to be made. The conductors 110, 120 are then centered in the connecting body 104. Their circumferential contour is ensured and is preferably circular. The annular elements 148 extend over the front end of the respective conductor 110, 120, while forming an annular bar 152 directed radially inwards, forming a stop when the annular element 148 is slid onto the conductor 110, 120.

An expansion element 150 is inserted centrally into the front end of each of the two conductors 110, 120. Each expansion element has several sections, at least a portion of which are frusto-conical and can be detached from one another in a preferably tool-free manner. The contour of the depicted longitudinal section through the expansion element 150 is also conical, so that the associated conductor 110, 120 is expanded all the more and is pressed into contact with the inside of the annular element 148 the further the expansion element 150 is introduced into the conductor 110, 120.

Figure 4:
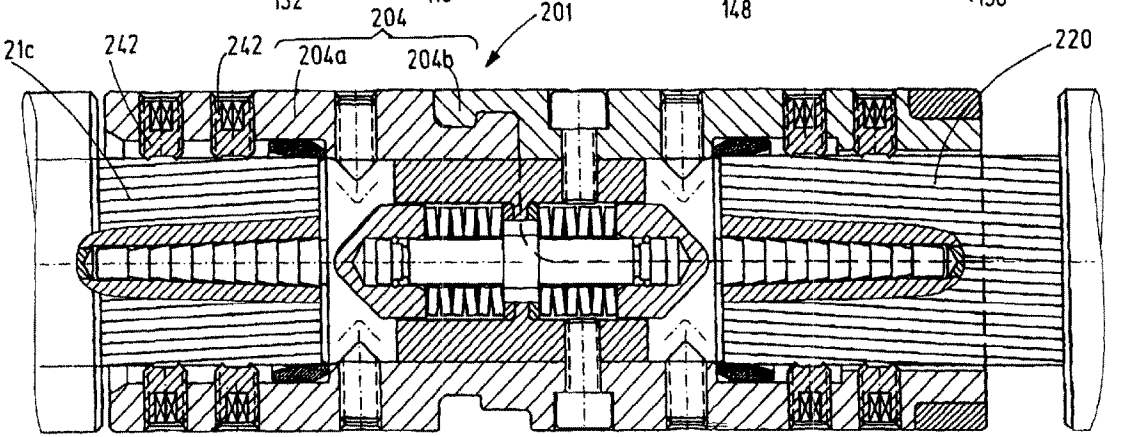
FIG. 4 is a side view in section of an apparatus according to a third exemplary embodiment of the invention.

FIG. 4 shows a longitudinal section through a third exemplary embodiment of the invention with an apparatus 201. The installation of apparatus 201 is simplified in that a second part 204*b*, in particular a second half, of the two-part or multiple-part tubular connecting body 204 can be taken off a first part 204*a* and mounted on the first part 204*a* again and fixed there, for example, with a ring, once the connecting body 204 is in the right position relative to the conductors 210, 220. Also possible is for both sides of the connecting body 204 to be formed in such a way.

For the installation, one side of the connecting body 204 is pushed onto the end of the first conductor 210 and fixed there by the holding screws 242. In the axial direction, two or more rows of holding screws 242, which are preferably equidistantly spaced apart in the circumferential direction, can be provided. The holding screws 242 of adjacent rows can be offset relative to one another in the circumferential direction, so that several and preferably all individual wires of the conductors 210, 220 are clamped. The end of the second conductor 220 can then be inserted into the open half shell on the other side of the connecting body 204 and, in particular, must not be pushed in in the longitudinal direction. This arrangement is advantageous because an axial movement of such cable conductors is only possible by application of significant forces due to their large dimensions.

Figure 5:
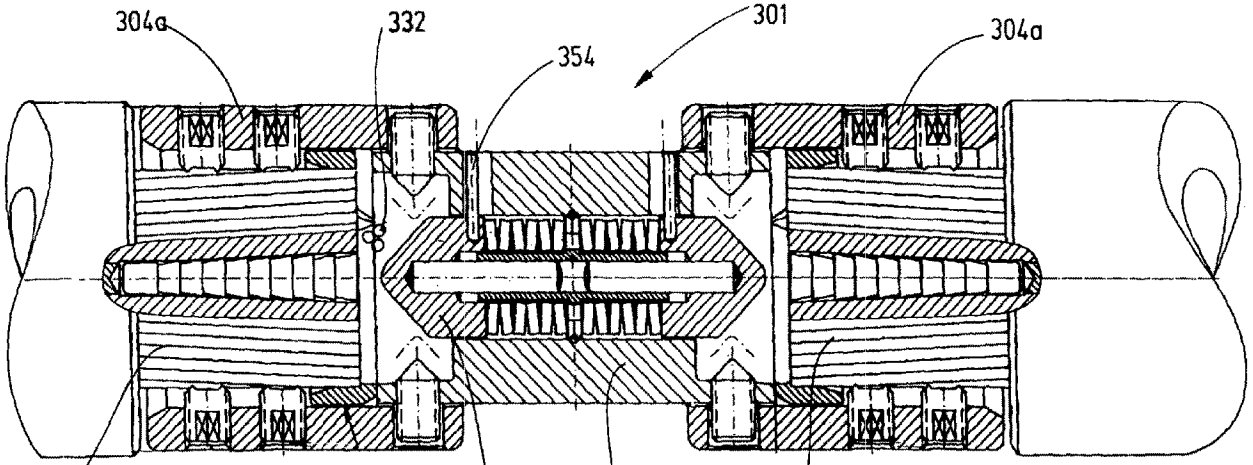
FIG. 5 is a side view in section of an apparatus according to a fourth exemplary embodiment of the invention.

FIG. 5 shows a longitudinal section through a fourth exemplary embodiment of the invention, with an apparatus 301, in which a first part 304*a* of the connecting body is mounted on an end of each conductor 310, 320. The two first parts 304*a* are then connected with a connecting element 340. The contact bodies 332 are introduced and compressed and placed under pressure by screwing in of the force application elements 318. The ensuing pre-tensioning on the force storage means 328 can be measured from outside the apparatus 301 by the axial position of pin-shaped signal elements 354. Signal elements 354 are arranged in the force storage 328 and extend radially outwards and penetrate radial holes in the connecting element 340. When the conical sections of the force storage move, for example, axially to the center of the apparatus 301, the signal element 354 is carried along. At the axial position of the signal element 354. From outside the apparatus 301 the extent the force storage 328 is pre-tensioned can be measured.

In one modified embodiment, the radial hole in the connecting element 340 for the passage of the signal element 354 can be only insignificantly larger than the dimension of the signal element 354. No axial relative movement of the signal element 354 relative to the connecting element 340 is then possible. Instead, the receiving opening for the signal element 354 provided in the force storage 328 has an angular face so that, in the case of an axial relative movement of the force storage 328 relative to the connecting element 340, the signal element 354 slides along the angular face and is then moved radially in the radial hole. The pre-tensioning of the force storage means 328 can then be measured from outside the apparatus 301 by the radial position of the signal element 354. For example, the signal element 354 is only visible or is flush with the connecting element 340 when the force storage 328 is adequately pre-tensioned and the contact force is thus adequate. The signal element 354 can be able to be moved axially and/or radially under a spring force load to eliminate the influence of the weight force, for example.

Figure 6:
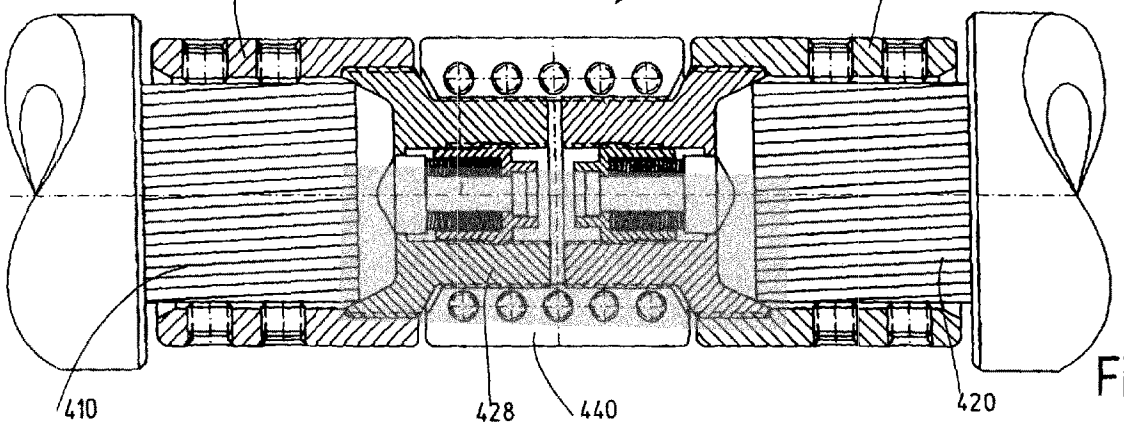
FIG. 6 is a side view in section of an apparatus according to a fifth exemplary embodiment of the invention.

FIG. 6 shows a longitudinal section through a similarly three-part fifth exemplary embodiment of the invention with an apparatus 401. The two first parts 404*a* of the connecting body are also each mounted on an end of a conductor 410, 420. These two first parts 404*a* are then connected with a multi-part connecting element 440, for example by two half shells that can be screwed to one another. A holding body of the force storage 428 surrounding the spring elements can project into the two first parts 404*a* of the connecting body axially by its two axial end sections opposite one another.

In particular, each axial end section can have an external thread to be able to be screwed into the two first parts 404*a*, and can form an axial stop for the ends of the two conductors 410, 420 by an end inside taper section.

One advantage of the described three-part exemplary embodiments is that both conductor ends can be mounted in advance individually and independently of one another. The pushing on of the two ends of the apparatus 301,401 assigned to the conductors 310, 410, 320, 420 is then very easily achievable. In particular, the associated cables do not have to be moved for this purpose. When the central connecting element 340, 440 is screwed on, the conductors 310, 410, 320, 420 are centered and the front sides are firmly clamped.

The two ends then mounted in advance are moved into a coaxial position and electrically and mechanically connected with the half shells. The half shells can have more than two segments. The form fitting for the mechanical and electrical connection can take place by a thread or circumferential grooves. The form-fitting connection of the individual parts of the connection improves the mechanical strength. The minimizing of remaining cavities increases the mass percentage and improves the low-loss power transmission.

Figure 7:
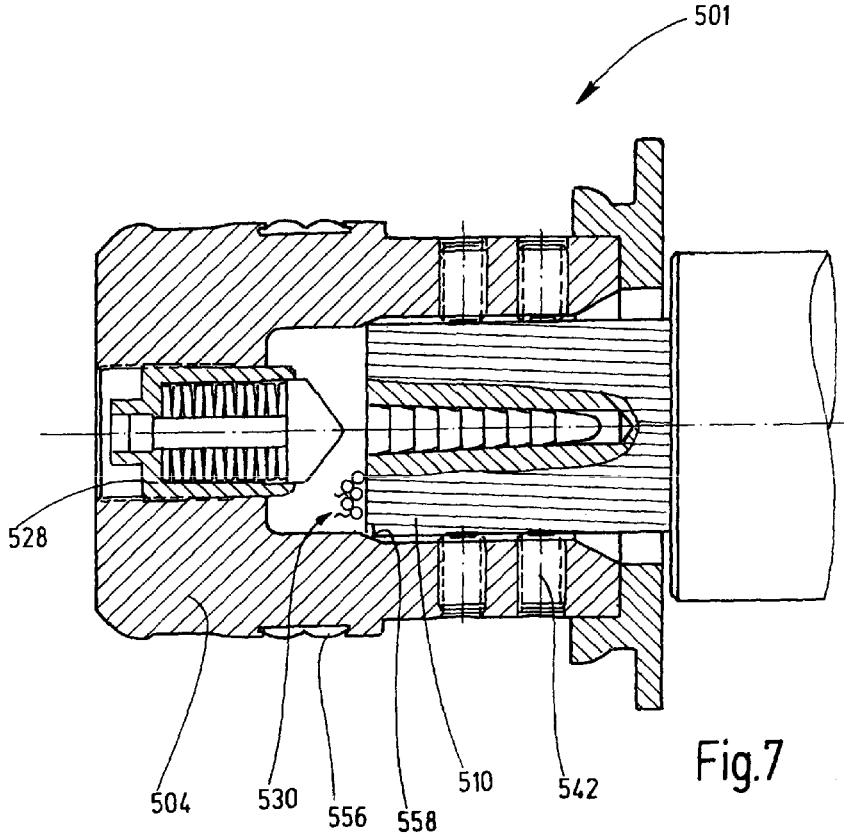
FIG. 7 is a side view in section of an apparatus according to a sixth exemplary embodiment of the invention.

FIG. 7 shows a longitudinal section through a sixth exemplary embodiment of the invention with an apparatus 501, which can be used for a plug-in system with lamellar contacts. In the case of such a pluggable connection part, generally no significant demands are made with respect to the axial tensile loading capacity of the conductor connection. The conductor front surface is prepared and the connecting or connection body 504 is pushed on. The connecting body 504 has a circumferential groove on the outside, into which a contact lamella 556 is inserted.

The connecting body 504 is filled with the contact medium 530 and pushed onto the end of the conductor 510 and mechanically fixed on the conductor end by the holding screws 542. A conical surface 558 on the connecting body 504 realizes the centering and the sealing of the edge of the front surface of the conductor 510. The contact force is then pre-tensioned by the force storage 528, which can be screwed into the connecting body 504 on the front side opposite the conductor 510.

Figure 8:
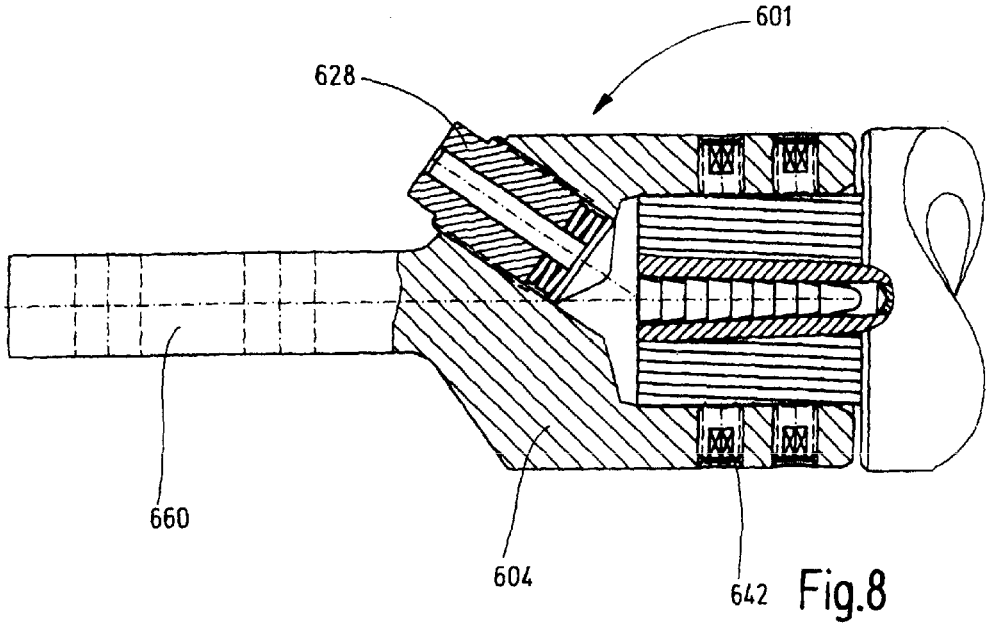
FIG. 8 is a side view in section of an apparatus according to a seventh exemplary embodiment of the invention.

FIG. 8 shows a longitudinal section through a seventh exemplary embodiment of the invention with an apparatus 601, which can be used, for example, for screw connection bolts on cable terminations and can be constructed according to the same design principle as the previously described apparatuses. The end section for receiving the connection fitting of an open wire or the screw connection to a busbar system can be designed, depending on the application, for example as massive round bolts, as a flat rectangular connecting lug with holes, or—as depicted with dashed lines in FIG. 8—as a cable shoe 660. At the cable conductor end, a screwed embodiment with holding screws 642 is depicted by way of an example, with compressed embodiments or other embodiments of the connection types also being possible.

The force storage 628 can be screwed into a hole in the connecting body 604. The hole creates an acute angle with the longitudinal axis of the apparatus 601 of preferably more than 15° and less than 80°, in particular more than 20° and less than 65°, and preferably more than 30° and less than 45°.

While various embodiments have been chosen to illustrate the invention, it will be understood by those skilled in the art that various changes and modifications can be made therein without departing from the scope of the invention as defined in the claims.

The invention claimed is:

1. An apparatus for making contact with an electrical cable conductor, the apparatus comprising:

a connecting body having a receiving space therein for receiving the cable conductor with the cable being inserted by a first end of the cable conductor into said receiving space;

a contact medium capable of making electrical contact with the front end of the cable conductor under a contact force, said contact medium having a plurality of electrically conductive contact bodies introduced into said receiving space and bearing against one another, at least some of said contact bodies being able to be brought into electrical contact-making contact with the front end of the cable conductor;

a force storage constantly maintaining the contact force on said contact medium against the front end of the cable connector.

2. An apparatus according to claim 1 wherein the contact force of one said contact bodies is transmitted to at least one of adjacent ones of said contact bodies, the cable conductor or said connecting body.

3. An apparatus according to claim 1 wherein said contact bodies have shapes capable of transmitting contact forces in an essentially direction-independent manner to at least one of adjacent ones of said contact bodies, the cable conductor or said connecting body.

4. An apparatus according to claim 1 wherein at least part of each of the said contact bodies comprises an at least partially curved surface.

5. An apparatus according to claim 4 wherein each said outer surface is at least partially spherical surface.

6. An apparatus according to claim 1 wherein said contact bodies are ball-shaped.

7. An apparatus according to claim 1 wherein said contact bodies have electrically conductive surface coatings having lower contact resistances relative to materials of said contact bodies.

8. An apparatus according to claim 1 wherein said contact medium comprises a pasty mass, said contact bodies being embedded in said pasty mass.

9. An apparatus according to claim 1 wherein a force application element contacts and applies said contact force on said contact medium.

10. An apparatus according to claim 9 wherein a force indicator provides a signal indicating that said force application element has applied an adequate contact force on said contact medium.

11. An apparatus according to claim 1 wherein a fixation device fixes an axial position of the cable conductor in the connecting body.

12. An apparatus according to claim 1 wherein said force storage is resilient.

13. An apparatus for making contact with an electrical cable conductor, the apparatus comprising:

a connecting body having a receiving space therein for receiving the cable conductor with the cable being inserted by a first end of the cable conductor into said receiving space;

a contact medium capable of making electrical contact with the front end of the cable conductor under a contact force, said contact medium having a plurality of electrically conductive contact bodies introduced into said receiving space and bearing against one another, at least some of said contact bodies being able to be brought into electrical contact-making contact with the front end of the cable conductor;

a force application element contacting and applying said contact force on said contact medium; and a force indicator providing a signal indicating that said force application element has applied an adequate contact force on said contact medium.

14. An apparatus according to claim 13 wherein the contact force of one said contact bodies is transmitted to at least one of adjacent ones of said contact bodies, the cable conductor or said connecting body.

15. An apparatus according to claim 13 wherein said contact bodies have shapes capable of transmitting contact forces in an essentially direction-independent manner to at least one of adjacent ones of said contact bodies, the cable conductor or said connecting body.

16. An apparatus according to claim 13 wherein said contact bodies are ball-shaped.

17. An apparatus according to claim 13 wherein said contact bodies have electrically conductive surface coatings having lower contact resistances relative to materials of said contact bodies.

18. An apparatus according to claim 13 wherein said contact medium comprises a pasty mass, said contact bodies being embedded in said pasty mass.

19. A connection, comprising:

an electrical cable conductor having a front end and having multiple wires;

a connecting body having a receiving space therein receiving said cable conductor with the cable being inserted by said first end of said cable conductor into said receiving space;

a contact medium capable of making electrical contact with said front end of said cable conductor under a contact force, said contact medium having a plurality of electrically conductive contact bodies introduced into said receiving space and bearing against one another, at least some of said contact bodies being in electrical contact with said front end of said cable conductor; and an expansion element inserted in said front end of said cable conductor.

20. A connection according to claim 19 wherein said expansion element is inserted centrally into said front end of said cable conductor.

21. A connection according to claim 19 wherein at least part of each of the said contact bodies comprises an at least partially curved surface.

22. A connection according to claim 21 wherein said curved outer surface has a radius of curvature less than 50 percent of said front end of said cable conductor.

23. A connection according to claim 21 wherein said curved outer surface has a radius of curvature less than 40 percent of said front end of said cable conductor.

24. A connection according to claim 21 wherein said curved outer surface has a radius of curvature less than 25 percent of said front end of said cable conductor.

25. A connection according to claim 19 wherein an annular element is mounted in said connecting body against adjacent said front end of said cable conductor, said annular element having an external diameter essentially equal to a clear width of said receiving space and an internal diameter essentially equal to an external diameter of said cable conductor adjacent said front end.

26. An apparatus for making contact with an electrical cable conductor, the apparatus comprising:

a connecting body having a receiving space therein for receiving the cable conductor with the cable being inserted by a first end of the cable conductor into said receiving space and having holes therein extending between an outside surface of said connecting body and said receiving space;

a contact medium capable of making electrical contact with the front end of the cable conductor under a contact force, said contact medium having a plurality of electrically conductive ball-shaped contact bodies introduced into said receiving space through said holes in said connecting body, said contact medium completely filling said receiving space, said contact bodies bearing against one another, at least some of said contact bodies being able to be brought into electrical contact-making contact with the front end of the cable conductor; and threaded pins threadedly engaged in said holes in said connecting body, closing said holes and applying forces on said contact medium to produce the contact force.

27. An apparatus according to claim 26 wherein a resilient force storage is in contact with and maintains the contact force of said contact medium against the front end of the cable conductor.

* * * * *